US012357081B2

(12) United States Patent
Sinton

(10) Patent No.: US 12,357,081 B2
(45) Date of Patent: Jul. 15, 2025

(54) STOWABLE FURNISHING

(71) Applicant: Alexander James Sinton, Doylestown, PA (US)

(72) Inventor: Alexander James Sinton, Doylestown, PA (US)

( * ) Notice: Subject to any disclaimer, the term of this patent is extended or adjusted under 35 U.S.C. 154(b) by 275 days.

(21) Appl. No.: 17/958,686

(22) Filed: Oct. 3, 2022

(65) Prior Publication Data

US 2024/0108122 A1 Apr. 4, 2024

(51) Int. Cl.

*A47B 3/06* (2006.01)
*A47B 3/00* (2006.01)
*A47B 3/083* (2006.01)

(52) U.S. Cl.

CPC ..... *A47B 3/002* (2013.01); *A47B 3/06* (2013.01); *A47B 3/083* (2013.01); *A47B 2003/006* (2013.01); *A47B 2200/005* (2013.01)

(58) Field of Classification Search

CPC .. A47B 3/002; A47B 3/02; A47B 3/06; A47B 3/04; A47B 3/083; A47B 2003/006; A47B 2003/045; A47B 2200/005; A47B 2013/026

USPC ..... 108/115, 118, 34, 67

See application file for complete search history.

(56) References Cited

U.S. PATENT DOCUMENTS 1,103,839 A * 7/1914 Duchez ..... A47C 3/285 248/412
1,262,356 A * 4/1918 Kirkland ..... A47B 3/087 108/159
1,876,400 A 9/1932 Cederquist
2,172,123 A * 9/1939 Ebert ..... A47B 3/02 248/431
2,722,973 A * 11/1955 Murcott ..... A47C 9/105 108/118
3,643,608 A * 2/1972 DeCesaris ..... A47B 3/12 248/431
3,738,286 A * 6/1973 Hoffman ..... A47B 9/16 108/147.22
4,934,638 A * 6/1990 Davis ..... A47C 9/105 108/118
5,865,127 A * 2/1999 Carter ..... A47B 3/12 108/115
6,125,769 A * 10/2000 Tsai ..... A47B 3/002 297/16.2
6,575,422 B1 6/2003 Zheng
9,314,077 B2 4/2016 Choi
9,402,467 B2 8/2016 Baoqing
2014/0374551 A1 12/2014 Carter
2016/0051041 A1* 2/2016 Choi ..... A47B 3/12 108/118

FOREIGN PATENT DOCUMENTS

DE 3016802 A * 11/1981 ..... A47B 3/12
EP 2918193 A1 * 9/2015 ..... A47B 13/023
FR 470566 A * 9/1914
WO WO-2005117645 A2 * 12/2005 ..... A47B 3/083

* cited by examiner

*Primary Examiner* — Janet M Wilkens

(57) ABSTRACT

A stowable furnishing is shown and described. A base for the stowable furnishing includes a first hub and a second hub. The first hub is a lower hub, and the second hub is an upper hub. A support is connected to the first hub and the second hub. A plurality of legs is rotatably connected to the first hub. One end of each leg is connected to one of a plurality of spars. An end of each spar is secured to the second hub.

3 Claims, 12 Drawing Sheets

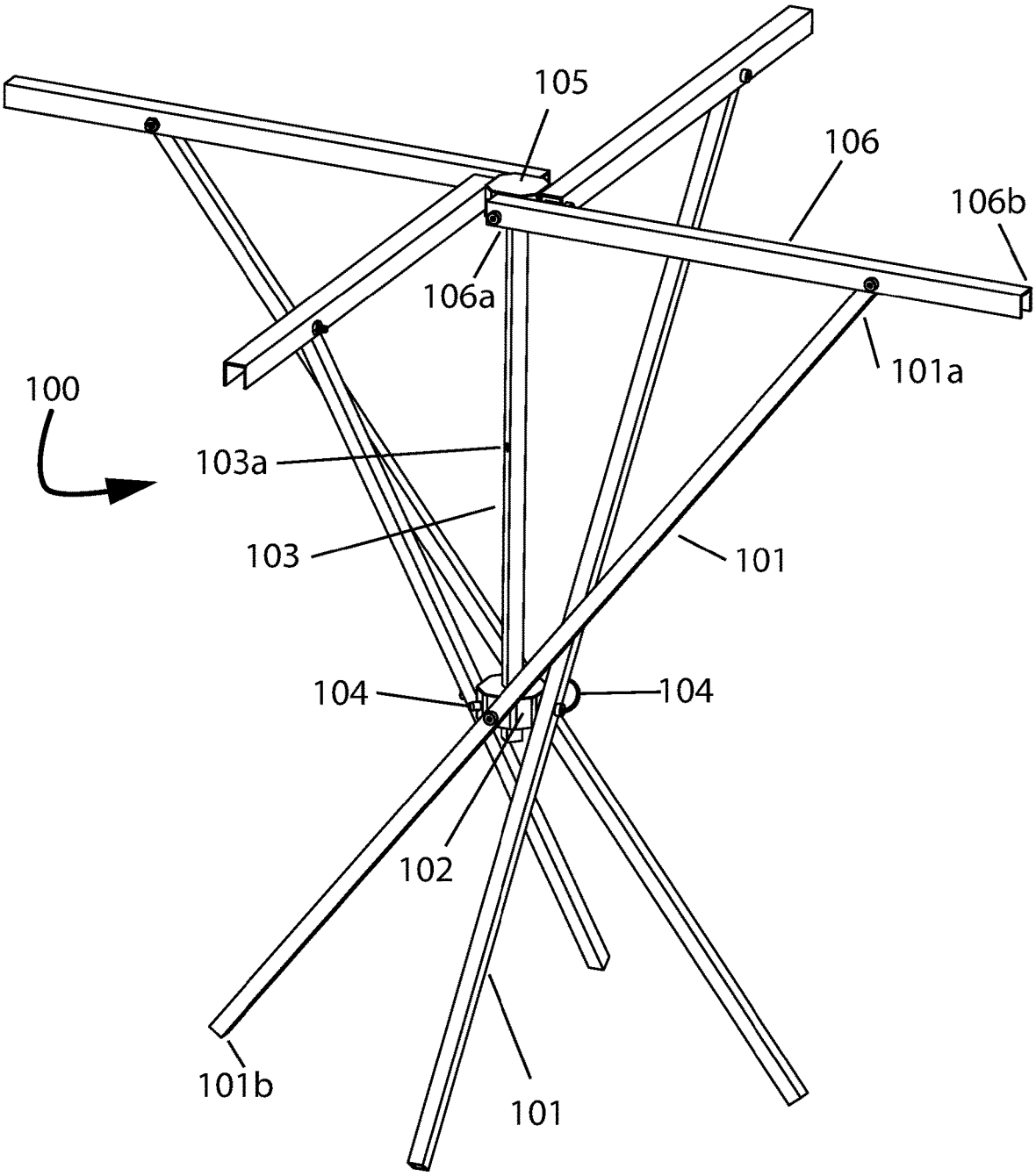
FIG. # 1

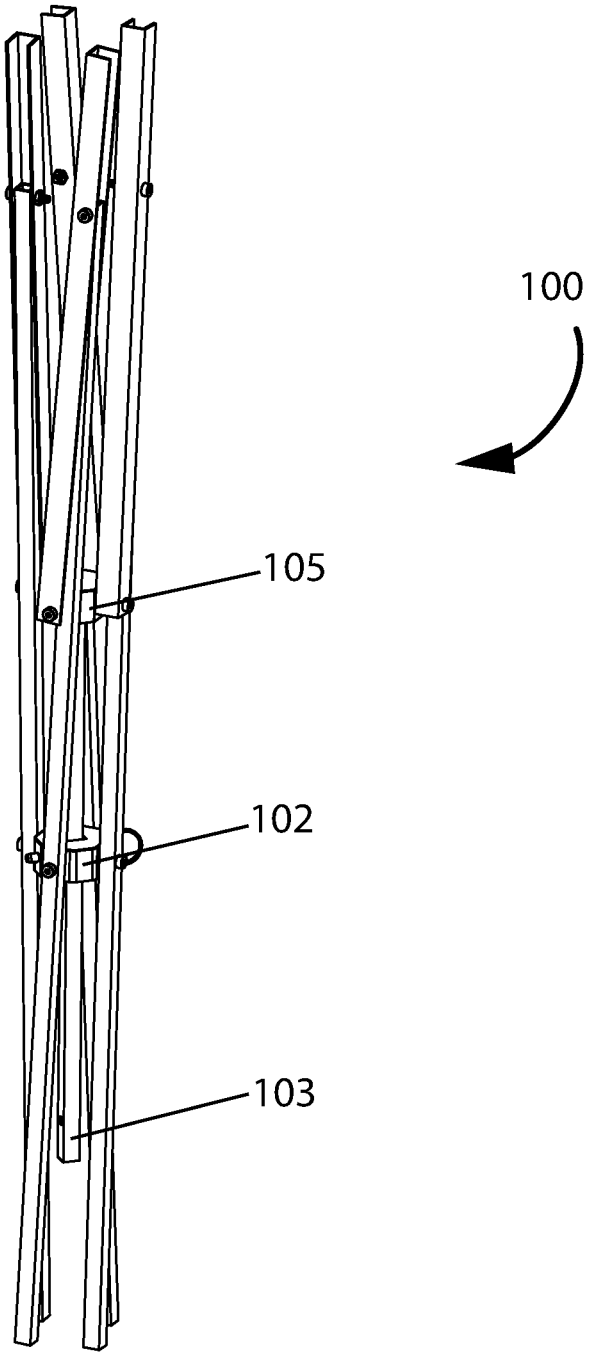
FIG. # 2

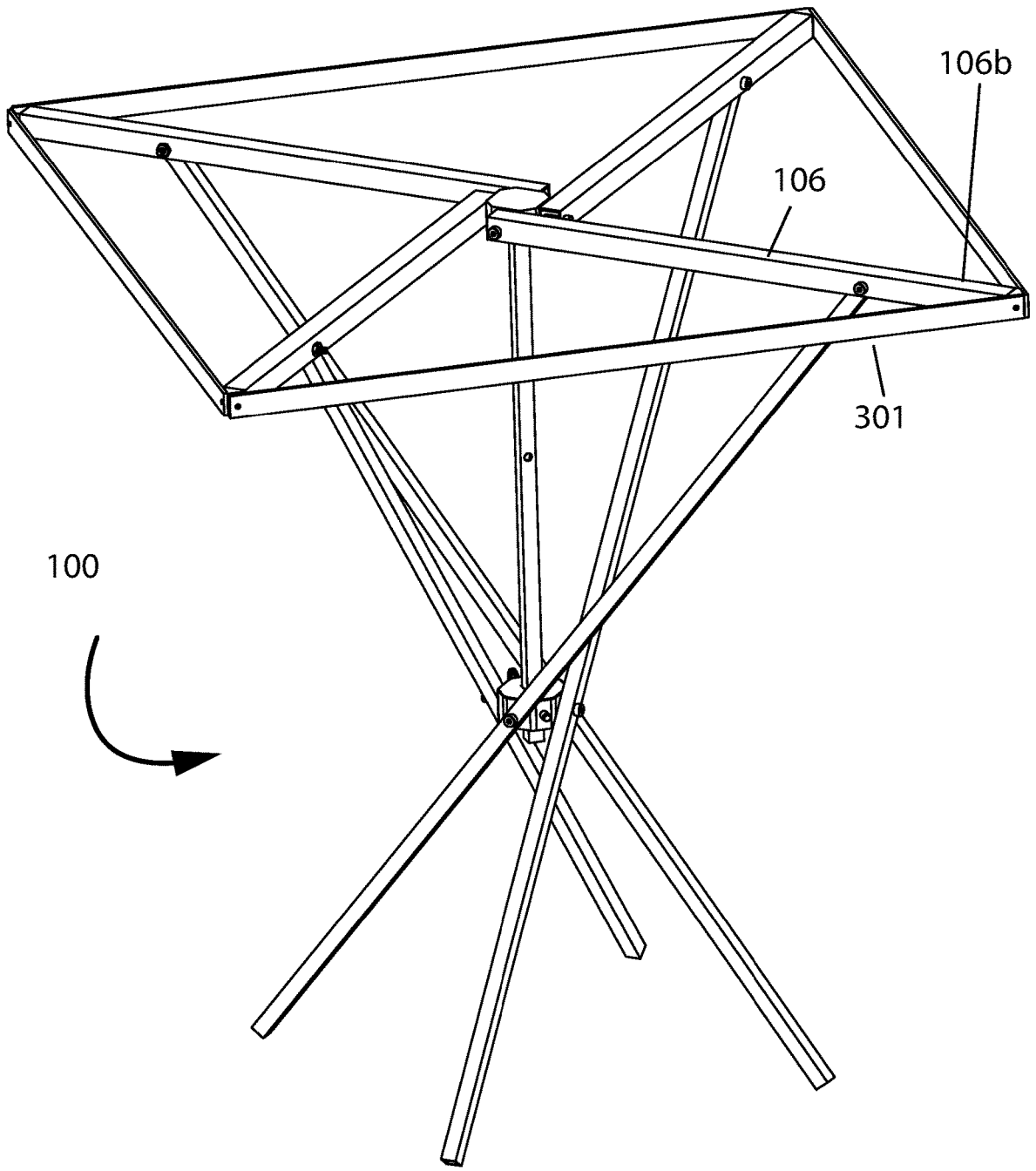
FIG. # 3

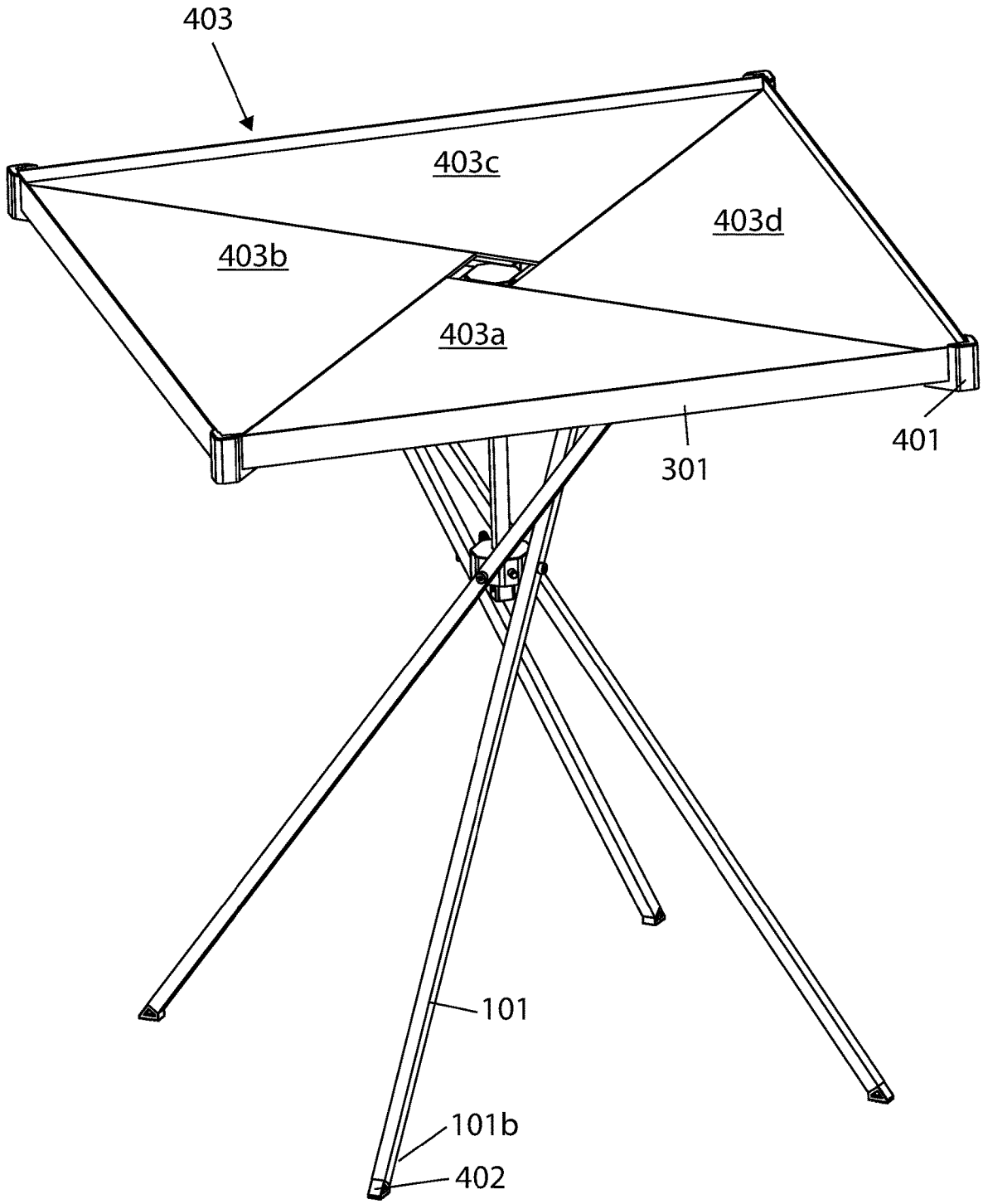
FIG. # 4

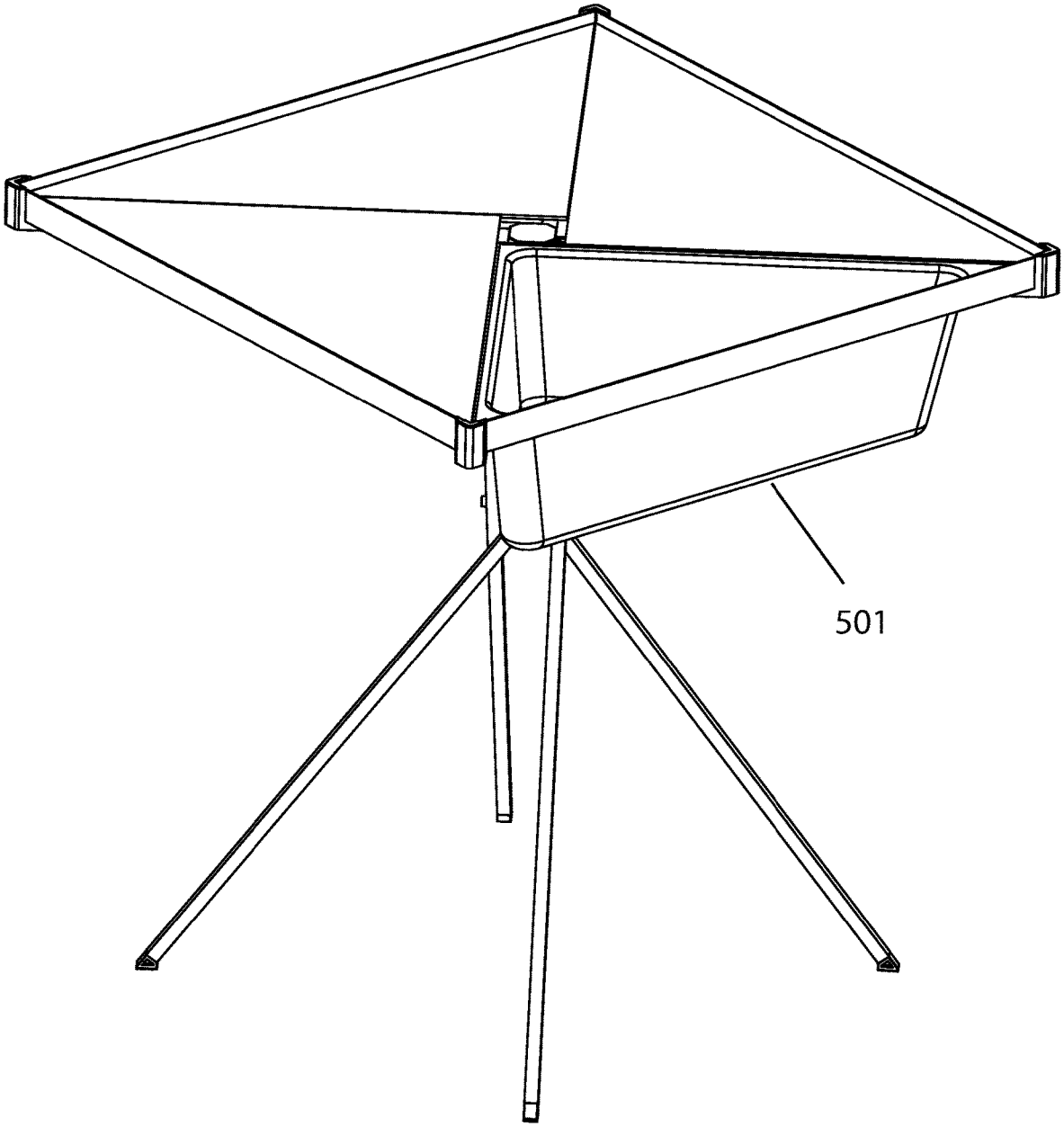
FIG. # 5

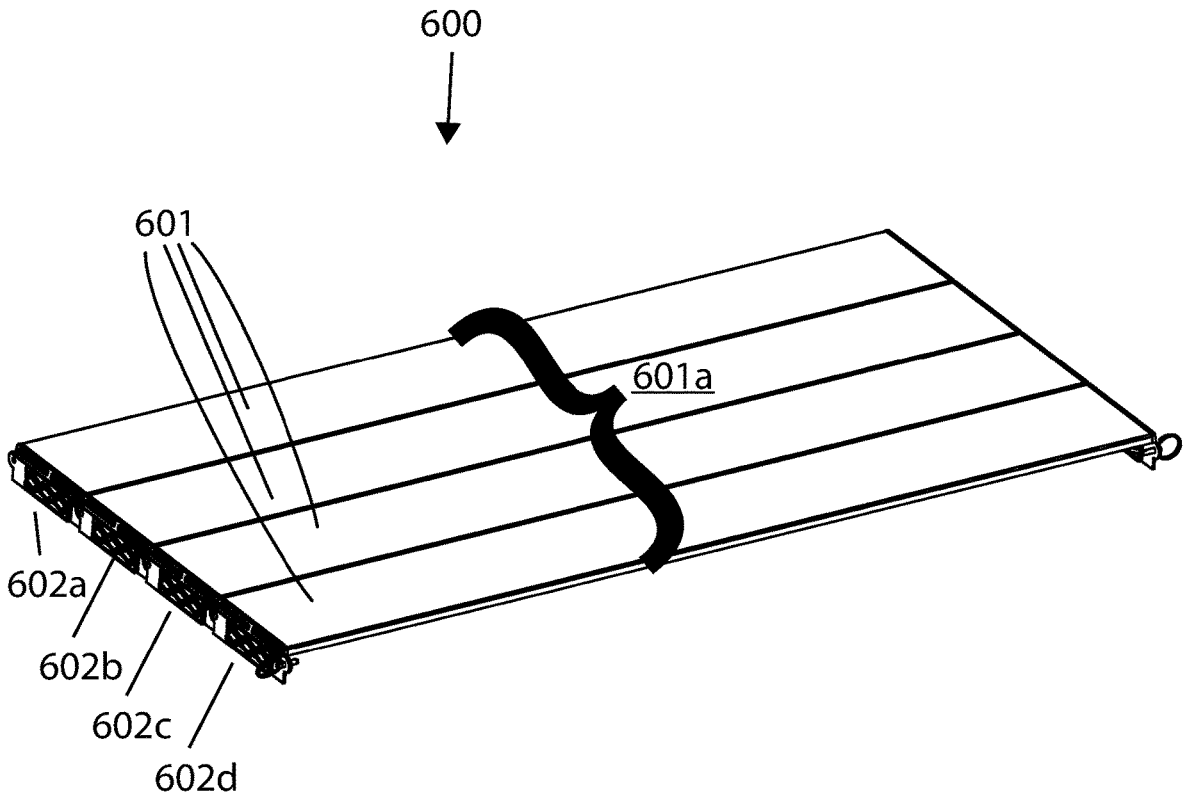
FIG. # 6A

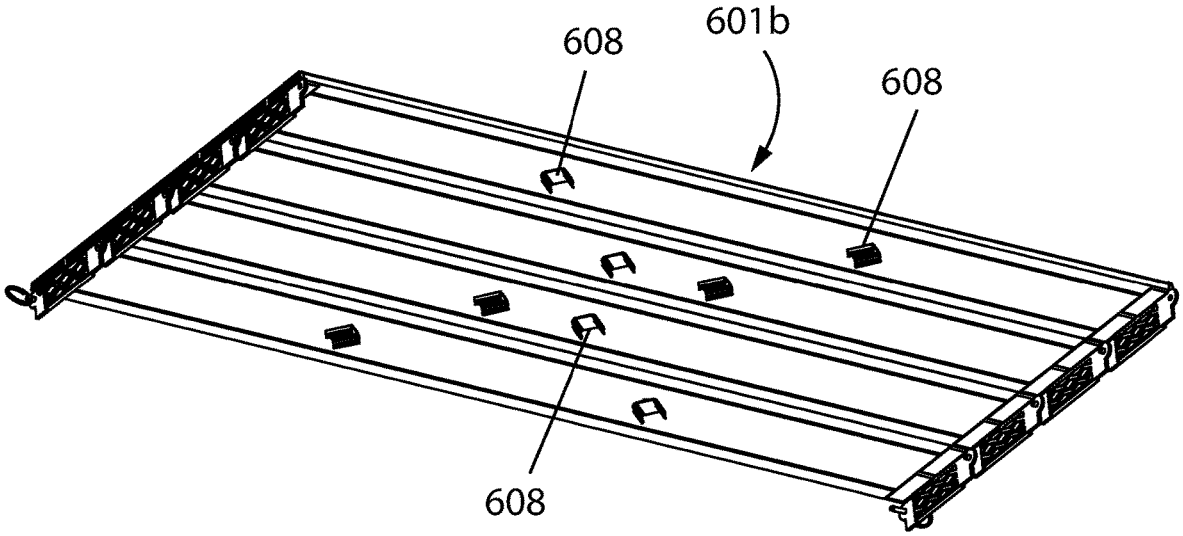
FIG. # 6B

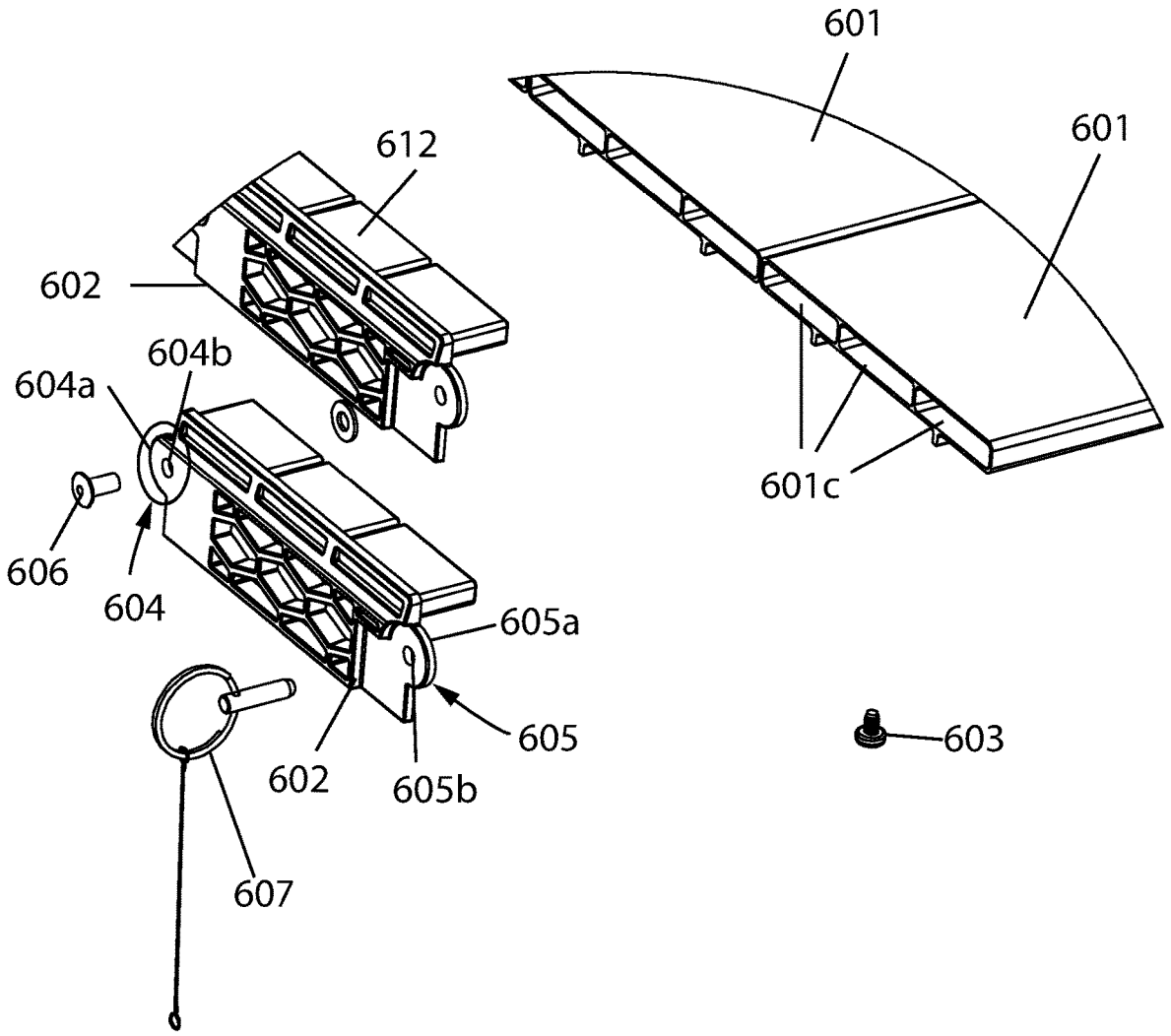
FIG. # 6C

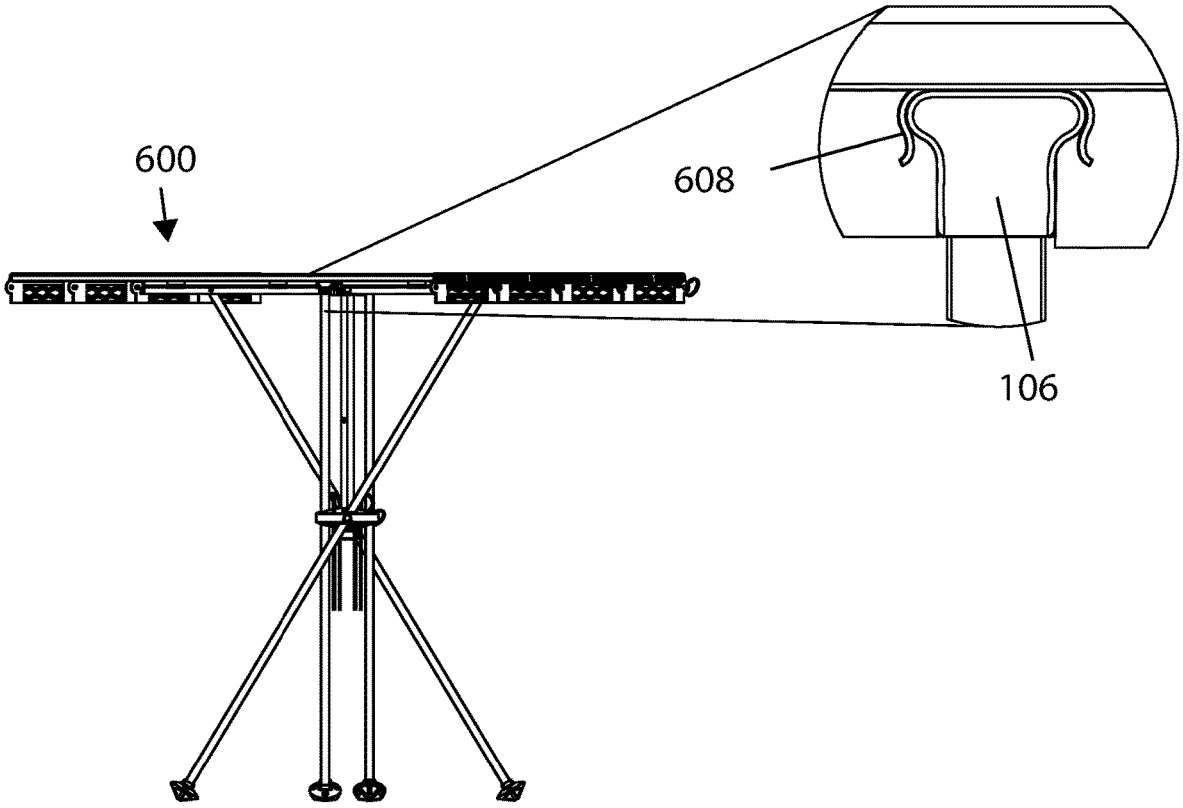
FIG. # 7A

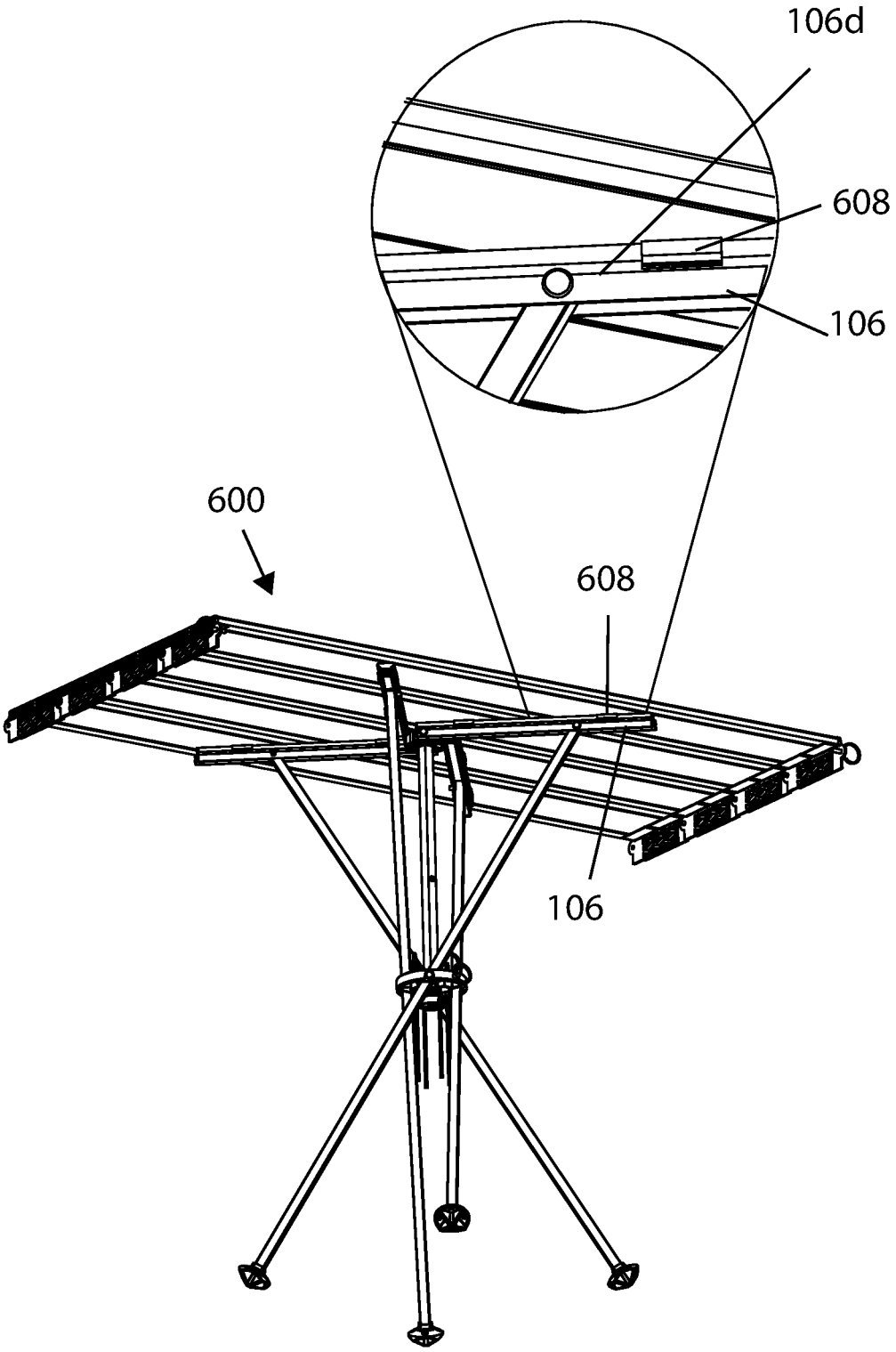
FIG. # 7B

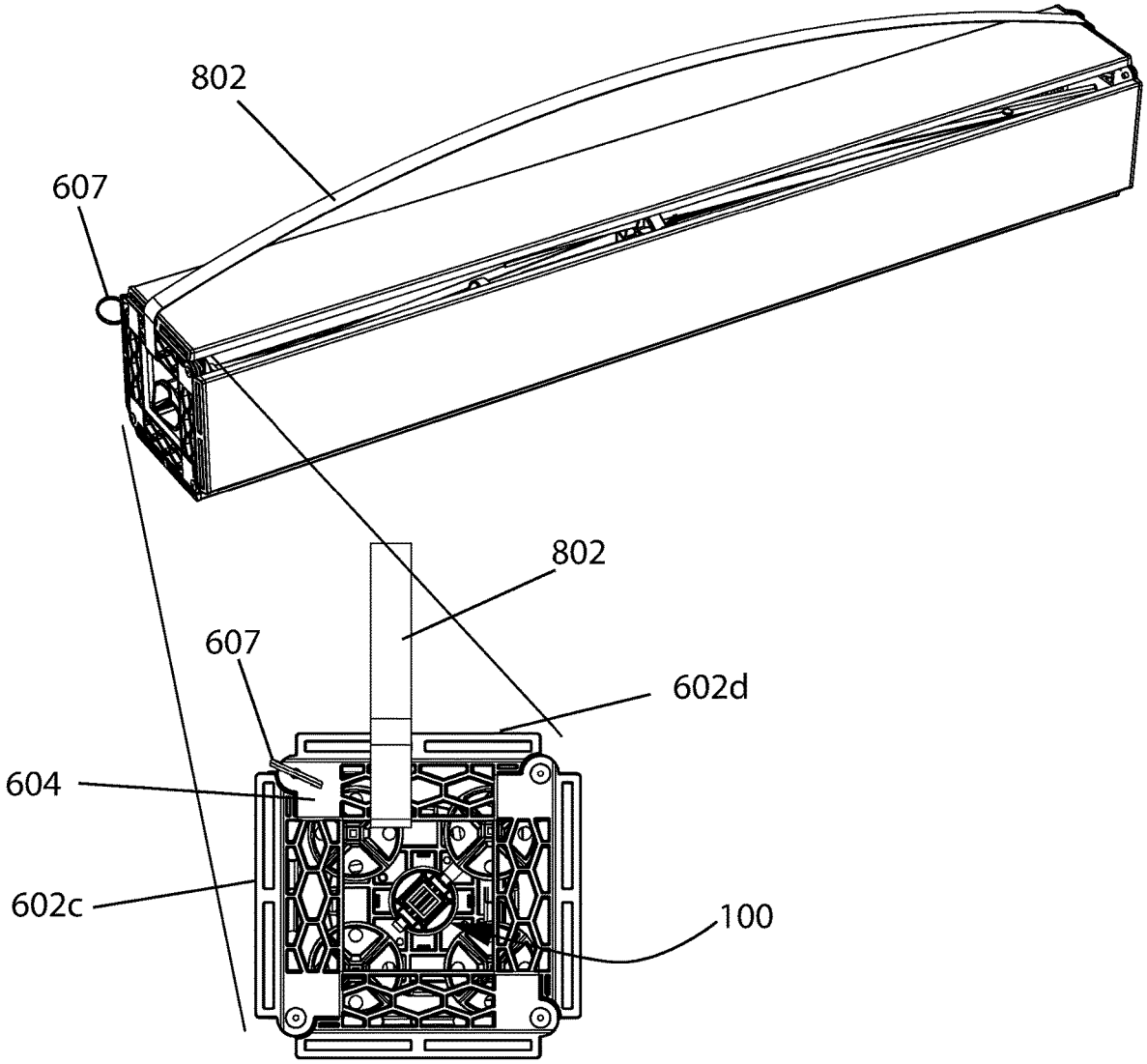
FIG. # 8A

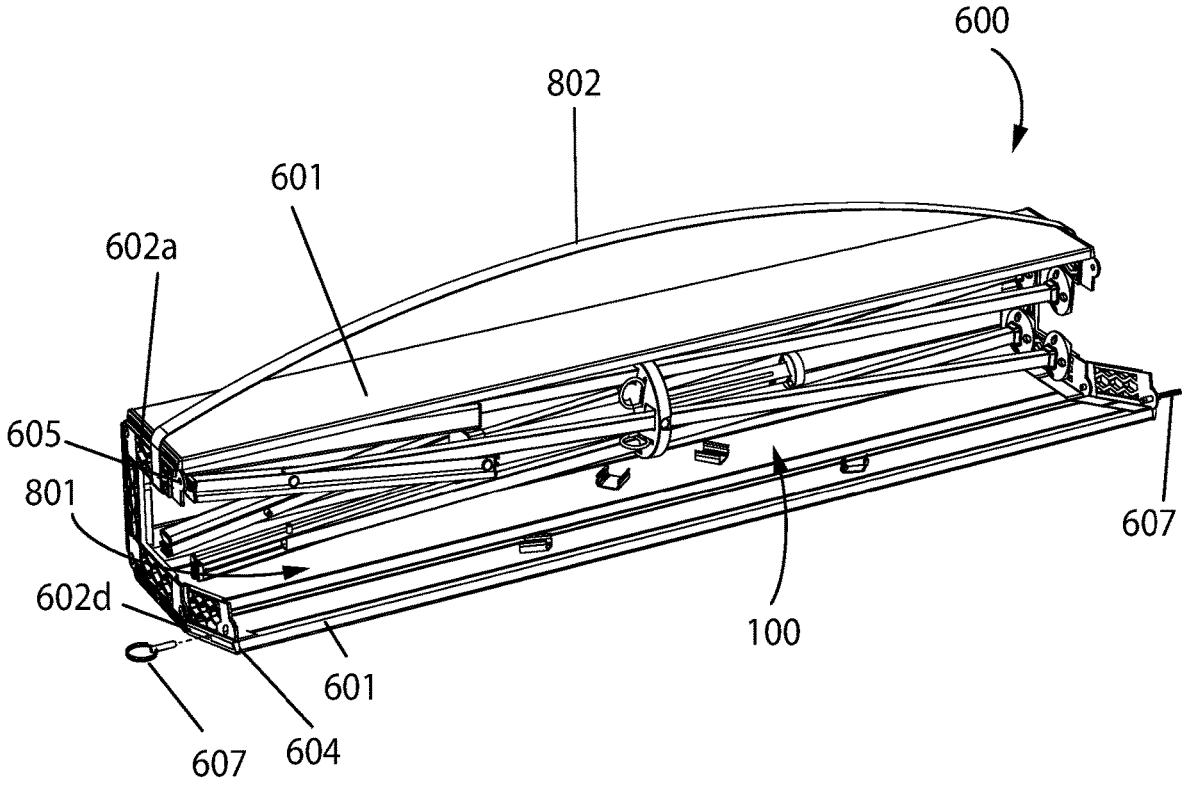
FIG. # 8B

STOWABLE FURNISHING

CROSS REFERENCE TO RELATED APPLICATIONS

This application claims the benefit of U.S. Provisional Application No. 63/251,786 filed on Oct. 4, 2021, and U.S. Provisional Application No. 63/330,862 filed on Apr. 14, 2022. The above identified patent application is herein incorporated by reference in its entirety to provide continuity of disclosure.

BACKGROUND OF THE INVENTION

The present invention relates to stowable furnishings. More particularly, the present invention provides a collapsible base and several options for top attachments.

An important and often disregarded device for the normal functioning of modern life is the stable flat surface for use as a table or chair. This fact of life becomes more apparent when people travel from their home or place of work for activities such as camping, picnicking, tailgating, boating, or going to the beach. It is then that the importance of a stable flat surface becomes apparent when someone wants to prepare food, play a game, set out a buffet, repair a vehicle, assemble something such as a fishing rod, or disassemble something such as a fish.

Existing patented and advertised portable tables are generally lacking in one of the following: a normal table surface height of approximately thirty inches, light weight, stable surface, high load capacity, a large working surface, compact stowed cross section, fast and simple assembly, or a durable surface. One common type of stowable table is the banquet table which consists of a large stiff top generally made from blow molded plastic and two steel legs which pivot for stowing.

These tables can be heavy and furthermore cannot be broken down smaller than the tabletop, so they require an area as large as the surface to store.

There are camping tables which overcome high weight by using a membrane for the top, such as cloth. These tables lack stiffness and durability. In addition, the strength required by the user to stretch the cloth tight enough for reasonable stability can be excessive. Cloth tabletops often overcome this limitation by providing recessed pockets for drinks, which limits the dimensions of a drink that it can hold to standard sizes.

There are folding tables which are very compact, but they often deploy to low heights. Some tables use telescoping tubes or folding spans for legs which can increase weight, complexity, load bearing capacity, and deployment time.

Consequently, there is a need for an improvement in the art of stowable furniture. The present invention substantially diverges in design elements from the known art while at the same time solves a problem many people face when conducting activities away from areas where tables or other furniture are typical, such as camping or tailgating. In this regard the present invention substantially fulfills these needs.

SUMMARY OF THE INVENTION

The present invention provides stowable furniture wherein the same can be utilized for providing convenience for the user when in need of an easy-to-use table or other piece of furniture. The base for a stowable furnishing includes a first hub and a second hub. The first hub is a lower hub, and the second hub is an upper hub. A support is connected to the first hub and the second hub. A plurality of legs is rotatably connected to the first hub. One end of each leg is connected to one of a plurality of spars. One end of each spar is secured to the second hub.

Another object of the base for a stowable furnishing is to include foot pads securing to a bottom end of each leg.

Another object of the base for a stowable furnishing is to include edge pieces. The edge pieces are removably secured to an exterior end of at least two spars. Further the edge pieces make up an entire perimeter of the base.

Another object of the base for a stowable furnishing is to have the first hub be movably connected to the support.

Another object of the base for a stowable furnishing is to include a movable pin secured through an aperture of the first hub. The movable pin will secure the support in a desired position.

Another object of the base for a stowable furnishing is to have the support be movably connected to the second hub.

Another object of the base for a stowable furnishing is to include a movable pin secured through an aperture of the second hub. The movable pin will secure the support in a desired position.

The top for a stowable furnishing includes a plurality of planar sections. Each of the plurality of planar sections is rotatably connected to the adjacent planer section. The sections are connected such that they form a single planar top section. The sections are connected such that they are able to rotate into a stored position.

Another object of the top for a stowable furnishing is to include end caps which are secured to each end of the plurality of planar sections.

Another object of the top for a stowable furnishing is to include a plurality of securement devices connected to the undersides of the plurality of planar sections.

Another object of the top for a stowable furnishing is for it to work with and secure to the base for stowable furnishings.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1 shows a perspective view of an embodiment of a base for stowable furnishings.

FIG. 2 shows a perspective view of an embodiment of a collapsed base for stowable furnishings.

FIG. 3 shows a perspective view of an embodiment of a base for stowable furnishings including edge pieces.

FIG. 4 shows a perspective view of an embodiment of a top to be connected to the base for stowable furnishings.

FIG. 5 shows a perspective view of an embodiment of a top to be connected to the base for stowable furnishings.

FIG. 6A shows a top perspective view of an embodiment of a top for stowable furnishings.

FIG. 6B shows a bottom perspective view of an embodiment of parts for the top for stowable furnishings.

FIG. 6C shows an exploded view of an embodiment of the top for stowable furnishings.

FIG. 7A shows a side view of an embodiment of the top for stowable furnishings secured to the base.

FIG. 7B shows a side perspective view of an embodiment of the top for stowable furnishings secured to the base.

FIG. 8A shows a perspective view of an embodiment of the top for stowable furnishings secured in a closed configuration about the stowable base.

FIG. 8B shows a perspective view of an embodiment of the top for stowable furnishings about the stowable base.

LIST OF REFERENCE NUMERALS

With regard to the reference numerals used, the following numbering is used throughout the drawings.

| | |
|---|---|
| 100 | base for stowable furnishings |
| 101 | legs |
| 101a | first end of a leg |
| 101b | second end of a leg |
| 102 | first hub |
| 103 | support |
| 103a | aperture of support |
| 104 | locking pin |
| 105 | second hub |
| 106 | spars |
| 106a | one end of spar |
| 106b | second end of spar |
| 106d | channel within spar |
| 301 | perimeter edge pieces |
| 401 | corner edge pieces |
| 402 | feet |
| 403 | top |
| 403a | triangle section |
| 403b | triangle section |
| 403c | triangle section |
| 403d | triangle section |
| 501 | basin |
| 600 | picnic tabletop |
| 601 | planar section |
| 601a | planar surface |
| 601b | underside of the planar surface |
| 601c | opening of planar section |
| 602 | end cap |
| 602a | end cap |
| 602b | end cap |
| 602c | end cap |
| 602d | end cap |
| 603 | fastener |
| 604 | securement section |
| 604a | rounded section |
| 604b | aperture |
| 605 | securement section |
| 605a | rounded section |
| 605b | aperture |
| 606 | fastener |
| 607 | removable pin |
| 608 | securement device |
| 612 | insert section of end cap |
| 801 | interior volume |
| 802 | strap |

DETAILED DESCRIPTION OF THE INVENTION

Reference is made herein to the attached drawings. Like reference numerals are used throughout the drawings to depict like or similar elements of the stowable furnishing. For the purposes of presenting a brief and clear description of the present invention, a preferred embodiment will be discussed as used for the stowable furnishing. The figures are intended for representative purposes only and should not be considered to be limiting in any respect.

Referring now to FIG. 1, there is shown a perspective view of an embodiment of a base for stowable furnishings 100. The base for stowable furnishings 100 includes a plurality of legs 101. The plurality of legs 101 shall number at least three legs. Any fewer than three will not allow for a stable base 100. In the shown embodiment four legs 101 are used to represent the plurality of legs 101. Each leg has a first end 101*a* and a second end 101*b*.

The plurality of legs 101 are each secured to a first hub 102 between the first end 101*a* and the second end 101*b* of each leg 101. In one embodiment each leg 101 is secured to the first hub 102 such that the legs 101 will rotate from a first position to a second position. In different embodiments each leg 101 may be attached using a different fastener. Different fasteners may include, for example, rivets, screws, nuts and bolts, or a clevis pin and a cotter pin. Each of these fasteners will allow for each leg 101 to rotate about the connection point.

A support 103 is connected to the first hub 102. In one embodiment the support 103 is movable connected to the first hub 102. In one embodiment the first hub 102 contains an aperture which will allow for the support 103 to move therethrough. In one embodiment the support 103 will have a plurality of apertures 103*a* therein. In the same embodiment the first hub 102 will movably house a locking pin 104. The locking pin 104 is configured to engage an aperture 103*a* of the support 103 holding it in place. In one embodiment the pin is held in place with a cotter pin. In another embodiment the locking pin 401 may be replaced by a detent. The detent will be located protruding from the aperture 301*a* of the support 301. In yet another embodiment the locking pin 104 may be replaced via a spring button. When the locking pin 104 is disengaged the support 103 will be free to move through the aperture of the first hub 102.

The support 103 is connected to a second hub 105. In one embodiment the second hub 105 is located at one end of the support 103. In another embodiment the support 103 is movable secured through an aperture of the second hub 105. In this embodiment the support 103 will be secured to the first hub 103 at a second end of the support 103. Further, in this embodiment the support 103 will have a plurality of apertures 103*a* therein. In the same embodiment the second hub 105 will movably house a locking pin. The locking pin is configured to engage an aperture 103*a* of the support 103 holding it in place. When the locking pin is disengaged the support 103 will be free to move through the aperture of the second hub 105.

A plurality of spars 106 are movably connected to the second hub 105 at one end 106*a* of each of the spars 106. In one embodiment each of the plurality of spars 106 are connected such that they rotate from a first position to a second position. In different embodiments each spar 106 may be attached using a different fastener. Different fasteners may include, for example, rivets, screws, or nuts and bolts. Each of these fasteners will allow for each spar 106 to rotate about the connection point.

In many embodiments the number of spars 106 will equal the number of legs 101. In the shown embodiment there are four legs 101 and four spars 106. Each leg 101 is rotatably connected at the first end 101*a* to a corresponding spar 106. Each leg 101 is connected to the corresponding spar 106 between the ends 106*a*, 106*b* of the spar 106. In different embodiments each the connection may be made using a different fastener. Different fasteners may include, for example, rivets, screws, or nuts and bolts. Each of these fasteners will allow for each leg 101 and spar 106 connection to rotate about the connection point.

Referring now to FIG. 2, there is shown a perspective view of an embodiment of a collapsed base for stowable furnishings 100. As discussed above many of the connections between the items of the base for stowable furnishings 100 are rotatable. These connections allow the base for stowable furnishings 100 to move from at least a first position to a second position. It is possible that other positions could be used for different purposes. Here the rotatable connections are shown rotated into a second position. When the connections are placed in the second position the base for stowable furnishings 100 is collapsed or stowed.

Further, as discussed above in different embodiments the support 103 is movably connected to the first hub 102. Here the support 103 is shown lowered through the first hub 102. This will allow the connects with the second hub 105 to also rotate. The movement of the support 103 allows for the connections as discussed to be placed in the second position the thus for the base for stowable furnishings 100 to be collapsed or stowed.

Using the connections as described herein the entire assembly will move as one. This means that each spar 106 and each leg 101 will move as one. As one leg 101 moves, at least one hub 102, 105 will move. This will move the other legs 101 and the spars 106 into place. Further, this means that when any one part is secured in place the entire base for a stowable furnishing 100 will be locked into place. This will create a base which is stable and that will not be prone to collapse. In this way the base will be able to hold a large amount of weight.

Referring now to FIG. 3, there is shown a perspective view of an embodiment of a base for stowable furnishings 100 including edge pieces. In some embodiments different additions may be added to the base for stowable furnishings 100. In the shown embodiment perimeter edge pieces 301 have been added to the base 100. In one embodiment the perimeter edge pieces 301 are movably attached to the second ends 106*b* of the plurality of spars 106. In another embodiment the perimeter edge pieces 301 are removably secured. In this embodiment once the base for stowable furnishings 100 is placed in the first position the perimeter edge pieces 301 may be attached to the second ends 106*b* of the spars 106. At least one benefit to the perimeter edge pieces 301 is the added support. When the perimeter edge pieces 301 are installed the base for stowable furnishings 100 will have an added rigidity.

Referring now to FIG. 4, there is shown a perspective view of an embodiment of a top to be connected to the base for stowable furnishings 100. In another embodiment corner pieces 401 are secured to the second ends of the spars. In one embodiment the corner edge pieces 401 are secured about the exterior of the connections of the perimeter edge pieces 301. In another embodiment the perimeter edge pieces 301 are connected to the corner edge pieces 401.

In different embodiments feet 402 may be attached to the second ends 101*b* of each leg 101. In one embodiment the feet 402 are designed to protect the floor where the base is placed. In another embodiment the feet 402 are designed to create a greater grip. In another embodiment the feet 402 are designed to provide a greater surface area for soft floors such as sand. In other embodiments the feet 402 may have features such as a hole to allow staking to the ground or clips to add weights. In yet further embodiments the feet 402 may include any combination of these features.

The base for stowable furnishings 100 can be used as a drying rack, a jack stand, or many other items, in one embodiment the base for stowable furnishings 100 can further include a top 403. In different embodiments different tops 403 may be used. In one embodiment the top 403 will form a chair. In another embodiment the top 403 forms a table. In the shown embodiment the top 403 is comprised of four triangular sections 403*a*, 403*b*, 403*c*, 403*d*. In one embodiment at least one of the triangular sections 403*a*, 403*b*, 403*c*, 403*d*, includes a plurality of apertures therein. Each of the triangular sections 403*a*, 403*b*, 403*c*, 403*d* is removably secured to the spars 106. In one embodiment the triangular sections 403*a*, 403*b*, 403*c*, 403*d* are held in place via a friction fit created solely by the weight of the triangular sections 403*a*, 403*b*, 403*c*, 403*d*. In some embodiments the triangular sections 403*a*, 403*b*, 403*c*, 403*d* are further removably secured to the perimeter edge pieces 301 or the corner edge pieces 401. In one embodiment the triangular sections 403*a*, 403*b*, 403*c*, 403*d* may also be broken into small pieces for smaller stowage. These smaller pieces may be attached to each other prior to attaching them to the base for stowable furniture 100.

Referring now to FIG. 5, there is shown a perspective view of an embodiment of a top to be connected to the base for stowable furnishings 100. In one embodiment one of the triangular sections 403*a*, 403*b*, 403*c*, 403*d* is replaced by a different section. In the shown embodiment the triangular section 403*a*, 403*b*, 403*c*, 403*d* is replaced with a basin 501. The basin 501 may be used for a sink or a catchall bin. In one embodiment a container of water may be added. When the container of water is used in conjunction with a pump to provide running water for the basin 501. This embodiment has the added benefit of providing weight to the base for stowable furnishings 100. In other embodiments parts may be added to provide storage below the top of the base.

Referring now to FIG. 6A, FIG. 6B, and FIG. 6C, there is shown multiple views of an embodiment of a top for stowable furnishings 100. In one embodiment picnic tabletop 600 is secured to the base for stowable furnishings 100. The picnic tabletop 600 is comprised of a plurality of planar sections 601. The planar sections 601 are secured together such that they form a planar surface 601*a*. In many embodiments the planar sections 601 are movably secured together. This will allow for the picnic tabletop 600 to be folded down as described in the description of FIG. 8A and FIG. 8B.

In one embodiment the planar sections 601 are directly secured to one another. In another embodiment each planar section 601 includes an end cap 602 (note on the references numbers: in general, the end cap will be 602, in some instances a specific end cap is 602*a*-602*d*). In one embodiment each planar section 601 includes two end caps 602. In some embodiments the end caps 602 will be secured together. In another embodiment hinges may be placed along juxtaposed edges of the planar sections 601. The hinges will allow for the planar sections 601 to be rotatably secured together.

In one embodiment, and as shown in FIG. 6C, an end cap 602 will be comprised of an insert section 612. In this embodiment the insert section 612 will fit within an opening 601*c* of a planar section 601. In another embodiment the end cap 602 will be comprised of a planar back side. In this embodiment the end cap 602 will be secured directly to the end of the planar section 601. For best results at least the ends of the planar section 601 should be solid. In yet another embodiment the end cap 602 will have a protrusion having a hollow interior. In this embodiment the end cap will be fitted over the planar section 601.

In several embodiments at least one fastener 603 is used to secure the end cap 602 in place. Each end cap 602 is further comprised of a first securement section 604 and a second securement section 605. In one embodiment the first securement section 604 includes a rounded section 604*a*. Within the rounded section 604*a* in an aperture 604*b*. A fastener 606 may be fitted within the aperture 604*b*. The second securement section 605 includes a rounded section 605*a*.

Within the rounded section 605*a* is an aperture 605*b*. A fastener 606 may be fitted within the aperture 605*b*. In another embodiment a removable pin 607 may be fitted within the aperture 605*b* (See the description of FIG. 8A and FIG. 8B). In one embodiment the second securement section 605 is on a different plane from the first securement section 604. This will allow for the first securement section 604 of one end cap 602*a* to fit against the second securement section 605 of another end cap 602*b*. This will create a flush fitting instead of having the entirety of the end cap 602*a* be on a separate plane for the other end cap 602*b*.

In several embodiments securement devices 608 are secured to an underside 601*b* of the planar section 601. In one embodiment the securement devices 608 are clips. In yet another embodiment the securement devices 608 are hook and loop connectors. In another embodiment the securement devices 608 are latches. Various embodiments of the securement devices 608 will be discussed in the description of FIG. 7A and FIG. 7B.

Referring now to FIG. 7A and FIG. 7B, there is shown multiple views of an embodiment of the top for stowable furnishings secured to the base. In the shown embodiments two different embodiments of securement devices 608 as clips are shown. In each embodiment the plurality of spars 106 are configured slightly differently to allow for the securement devices 608 to attach.

In a first embodiment each of the plurality of spars 106 is rounded and widened at one side. In this embodiment the clip 608 is made to be slightly flexible. The clip 608 is further shaped similarly to the shape of the plurality of spars 106. The clip 608 will widen as it passes over the shape of the plurality of spars 106 and spring back to shape as the spar 106 narrows. In this fashion the clip 608 will be secured about the spar 106 holding the picnic tabletop 600 in place.

In a second embodiment each of the plurality of spars 106 has a channel 106*d* located along each side of the spar 106. In this embodiment the clip 608 is made to be slightly flexible. The clip 608 is further shaped to be of a similar size to the spar 106. In one embodiment the Clip 608 will have a protrusion located on each interior side of the clip 608. The protrusions will force the clip 608 to widen as it passes over the spar 106. The clip 608 will then spring back to shape as the protrusions enter the channels 106*d* of the spar 106. In this fashion the clip 608 will be secured about the spar 106 holding the picnic tabletop 600 in place.

Referring now to FIG. 8A and FIG. 8B, there is shown multiple views of an embodiment of the top for stowable furnishings secured about the stowable base. In some embodiments where the planar sections 601 of the picnic tabletop 600 are movably secured together the picnic tabletop 600 may be folded down and the base for stowable furnishing 100 may be stored in an interior volume 801 created by the folded planar sections 601. In this embodiment at least one strap 802 may be secured to at least one of the planar sections 601. The strap 802 will allow for easier transportation. In another embodiment the strap 802 is removably secured to the planar section 601.

In one embodiment, as mentioned above the planar sections 601 include at least one removable pin 607. The removable pin 607 will allow for planar sections 601 at opposite ends of the picnic tabletop 600 to be secured together. In this embodiment first securement section 604 of one end cap 602*a* will be able to connect to another securement section 605 of another end cap 602*d*. The pin will be placed through the apertures of each holding the planar sections in a folded configuration.

It is therefore submitted that the invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A base for a stowable furnishing, the base comprising:
a first hub and a second hub, wherein the first hub is a lower hub and the second hub in an upper hub;
a support is connected to the first hub and the second hub;
a plurality of legs rotatably connected to the first hub;
one end of each leg is connected to one of a plurality of spars;
one end of each spar is secured to the second hub;
edge pieces removably secured to an exterior end of at least two spars, wherein the edge pieces make up an entire perimeter of the base.

2. A base for a stowable furnishing, the base comprising:
a first hub and a second hub, wherein the first hub is a lower hub and the second hub in an upper hub;
a support is connected to the first hub and the second hub;
a plurality of legs rotatably connected to the first hub;
one end of each leg is connected to one of a plurality of spars;
one end of each spar is secured to the second hub;
wherein the support is movably connected to the first hub.

3. The base for a stowable furnishing of claim 2, further comprising a movable pin secured through an aperture of the first hub, wherein the movable pin will secure the support in a desired position.

* * * * *